US006379179B2

(12) United States Patent
Shinohara

(10) Patent No.: US 6,379,179 B2
(45) **Date of Patent: *Apr. 30, 2002**

(54) SEMICONDUCTOR SIGNAL CONNECTOR

(75) Inventor: Tatsuo Shinohara, Yamanashi (JP)

(73) Assignee: Fanuc Ltd., Yamanashi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,406

(22) Filed: Dec. 10, 1998

(30) Foreign Application Priority Data

Dec. 10, 1997 (JP) ..... 9-356359

(51) Int. Cl.[7] ..... H01R 31/08; H01R 13/64
(52) U.S. Cl. ..... 439/510; 439/252
(58) Field of Search ..... 439/507, 510, 439/512, 513, 509, 252

(56) References Cited

U.S. PATENT DOCUMENTS

| | | | | |
|---|---|---|---|---|
| 3,932,013 A | | 1/1976 | Yeager et al. | 339/19 |
| 3,997,229 A | | 12/1976 | Narazony et al. | 339/19 |
| 4,179,173 A | * | 12/1979 | Rise, III | 439/507 |
| 4,196,444 A | * | 4/1980 | Butner et al. | 357/81 |
| 4,353,610 A | * | 10/1982 | Deters | 439/510 |
| 4,820,194 A | | 4/1989 | Stine | 439/510 |
| 4,851,765 A | * | 7/1989 | Driller et al. | 324/158 F |
| 5,782,655 A | * | 7/1998 | Stefaniu et al. | 439/510 |
| 5,921,810 A | * | 7/1999 | Murakoshi | 439/510 |
| 6,036,534 A | * | 3/2000 | Hoyt et al. | 439/510 |

FOREIGN PATENT DOCUMENTS

| | | |
|---|---|---|
| EP | 0 361 971 | 4/1990 |
| JP | 9-259996 | 3/1997 |

* cited by examiner

*Primary Examiner*—Brian Sircus
*Assistant Examiner*—Chandrika Prasad
(74) *Attorney, Agent, or Firm*—Staas & Halsey, LLP

(57) ABSTRACT

A semiconductor signal connector has a contact area provided with a contact part. The contact part is elongated in a transverse direction so that a signal terminal can contact at any location thereof. Further, the semiconductor signal connector has a first contact part to contact a first signal terminal, a second contact part to contact a second signal terminal, and a connecting part formed by a deformable member for connecting the first contact part and the second contact part.

9 Claims, 10 Drawing Sheets

SEMICONDUCTOR SIGNAL CONNECTOR

BACKGROUND OF THE INVENTION

1. Field of the Invention

The present invention relates to a signal connector, and more particularly to a semiconductor signal connector which connects signal terminals between such a semiconductor device as a power module and a printed circuit board.

2. Description of the Related Art

For controlling power to be supplied to such a drive device as a servo-motor, switching devices using semiconductor devices, such as IGBT (Insulated Gate Bipolar Transistor) and IPM (Intelligent Power Module) are used. IPM is a composite device where a drive component and a control component are included in an IGBT.

Control signals of the semiconductor device are transferred by connecting a signal conductor to a control terminal of the semiconductor device side. In order to connect a signal conductor to a control terminal of the semiconductor device side, the signal conductor is directly soldered to a tab of the semiconductor side, or a fastening tab is used. For connection by a fastening tab, a receptacle where a connection terminal called a fastening terminal is connected to an electric wire by crimping or soldering is used, and this receptacle is connected to a tab of the semiconductor device side.

FIG. 10 is a diagram depicting the connection by a fastening tab. FIG. 10 is an example of IGBT. A semiconductor device 101 comprises current terminals 111 and plate type fastening tabs 112, and inputs control signals by connecting the fastening tabs 112 to control signal conductors.

It is known that a pin type terminal called a header pin is used instead of the above mentioned plate type tab to connect a signal conductor. FIG. 11 and FIG. 12 are diagrams depicting connection by header pins. FIG. 11 is an example of IGBT and FIG. 12 is an example of IPM. A semiconductor device 102 or 103 comprises current terminals 111 and pin type control terminals 113 for inputting control signals, and a control signal conductor is connected by connecting a connector, which is not illustrated here, to this control terminal. A pin 114 is a structural member for positioning the connector.

Connection using a connector has been adopted for automating manufacturing and simplifying the circuit structure of an amplifier and other components by directly connecting signal conductors between the board which outputs control signals and the semiconductor device.

FIG. 13 is a diagram depicting connection by a conventional connector. A connector 100 in FIG. 13 is a connector called a bottom entry connector. In this connector 100, a control terminal 113 of a semiconductor device 3 side (male side) is inserted to a connector 100 disposed at a control printed circuit board 2 side from the soldered surface side or the component surface side of the printed circuit board 2 so that the control terminal 113 can be inserted to a contact area 110 inside the connector 100.

With conventional semiconductor signal connectors, however, connection with a signal conductor is difficult, and in some cases, problems occur in terms of automation, reliability and maintainability.

In the case of a conventional semiconductor signal connector, alignment between the control terminal of the semiconductor device side and the connector disposed at the control printed circuit board side is difficult, and connection of a signal conductor is difficult if the positional shift is large.

A diameter of an opening of a conventional bottom entry connector for inserting a pin is □0.8, and a diameter of a normally used header pin is □0.64, therefore there is no margin for positional shift, and the control terminal of the semiconductor device side and the connector must be aligned accurately.

Generally, pin array accuracy of the control terminal of the semiconductor device side is lower than that of the connector, and it is also highly possible that contacting during packaging and transporting causes positional shift to the tips of the pins. This makes it difficult for a conventional semiconductor signal connector to connect with a signal conductor.

Also, in the case of a conventional semiconductor signal connector, a large insertion force and extraction force required for connecting and disconnecting the semiconductor device to/from the connector may make connection with the signal conductor difficult, and this also may cause failure to mounted components. Insertion force and extraction force at connecting and disconnecting may cause warp of the printed circuit board, and such deformation of the printed circuit board may damage components or cause wire breakage.

Such positional shift, large forces required for connecting and disconnecting, and warp of a printed circuit board and component failure caused by the force will cause problems to semiconductor devices in terms of the automation of signal conductor connection, reliability and maintainability.

SUMMARY OF THE INVENTION

An object of the present invention is to solve the problems of conventional semiconductor signal connectors and to provide a semiconductor signal connector which connects with a signal conductor easily.

A semiconductor signal connector in accordance with the present invention comprises a contact area where a contact part which can contact with a signal terminal is elongated in a direction roughly perpendicular to the center of axis direction of the signal terminal, so that the signal terminal can contact any location of the elongated contact part of the contact area.

The contact area comprises the first part to be connected with the first signal terminal, the second part to be connected with the second signal terminal, and a connecting part which connects the first and second signal terminals, and the connecting part is formed by a deformable material or structure.

According to the semiconductor signal connector of the present invention, a signal conductor can be connected easily. For example, alignment with the control terminal at the semiconductor device side and the connector disposed at the control printed circuit board side is easy, and a signal conductor can be connected easily, even if the positional shift between them is large.

BRIEF DESCRIPTION OF THE DRAWINGS

The foregoing and other objects and features of the invention will become apparent from the following description of preferred embodiments of the invention with respect to the accompanying drawings, in which.

DESCRIPTION OF THE PREFERRED EMBODIMENTS

First Embodiment

Figure 1:
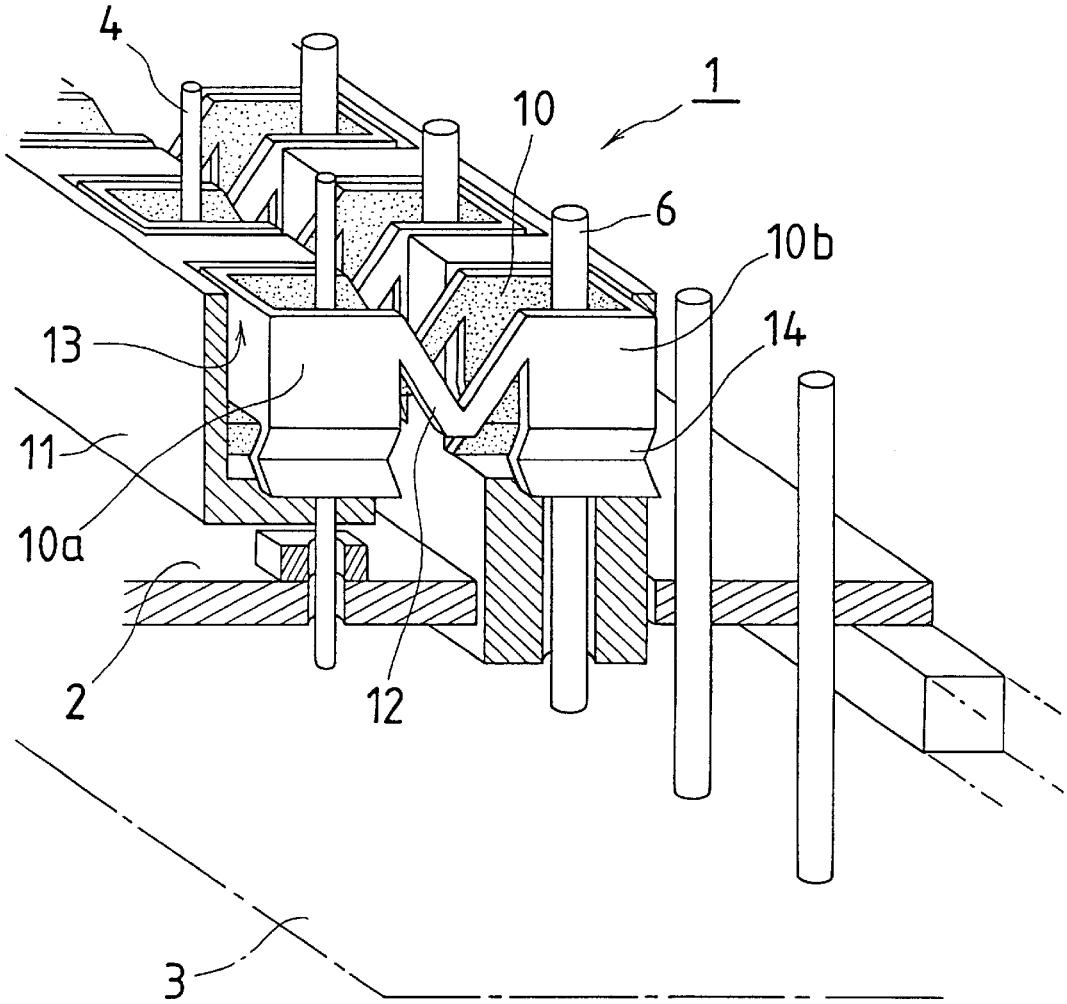
FIG. 1 is a diagram for describing a first and a second aspect of the semiconductor signal connector in accordance with the present invention, and depicts a part of the connector by a perspective view (partial cross-sectional view)

A first aspect of the connector in accordance with the present invention is described referring to FIG. 1.

A connector 1 connects a header pin 4, which is a signal terminal of a printed circuit board 2 side, and a header pin 6, which is a signal terminal of a semiconductor device 3 side. These signal terminals may be plate type terminals, such as fastening terminals, instead of these header pins.

The connector 1 comprises a socket 11 formed with an insulating material composed of such resins as polyamide resin and PPS, and a conductive contact area 10 which is attached inside a concave area 13 formed in the socket 11. The contact area 10 may have a configuration that connects a pair of signal terminals (that is, one header pin 4 and one header pin 6), or may have a configuration that connects two or more pairs of signal terminals. Dimensions of the socket 11 are defined according to the number of contact areas 10.

To embed a plurality of contact areas 10 in the socket 11, space between each contact areas 10 is set according to the arrangement space of the printed circuit board 2, and the header pins 4 and 6 of the semiconductor device 3.

Each contact area 10 has one pair of contact parts 14 at locations which sandwich the header pin 4 and the header pin 6 from the left and right respectively. As a result, each contact part 14 contacts the outer surface of the header pin 4 and the header pin 6. The contact part 14 is comprised of a pair of conductive pieces 14*c* and 14*d* (see FIG. 4) which are disposed facing each other. The header pins 4 and 6 are inserted between the pieces 14*c* and 14*d*, so that the header pins 4 and 6 are connected by the resilience of the pieces 14*c* and 14*d* from the left and right.

Second Embodiment

A second aspect of the connector is described next referring again to FIG. 1.

The contact area 10 comprises a part 10*a* of the printed circuit board 2 side, a part 10*b* of the semiconductor device 3 side, and a flexible contact connecting part 12 which connects both parts 10*a* and 10*b*. The connecting part 12 deforms to absorb the positional shift of the semiconductor device 3 relative to the printed circuit board 2. As a consequence, the deformation of the connecting part 12 makes it possible to completely connect the member of the semiconductor device side and the member of the printed circuit board side easily, even if the structure at the contact area 10 is not manufactured with high accuracy.

Third Embodiment

A third aspect of the connector is described next referring to FIG. 2 and FIG. 3.

Figure 2:
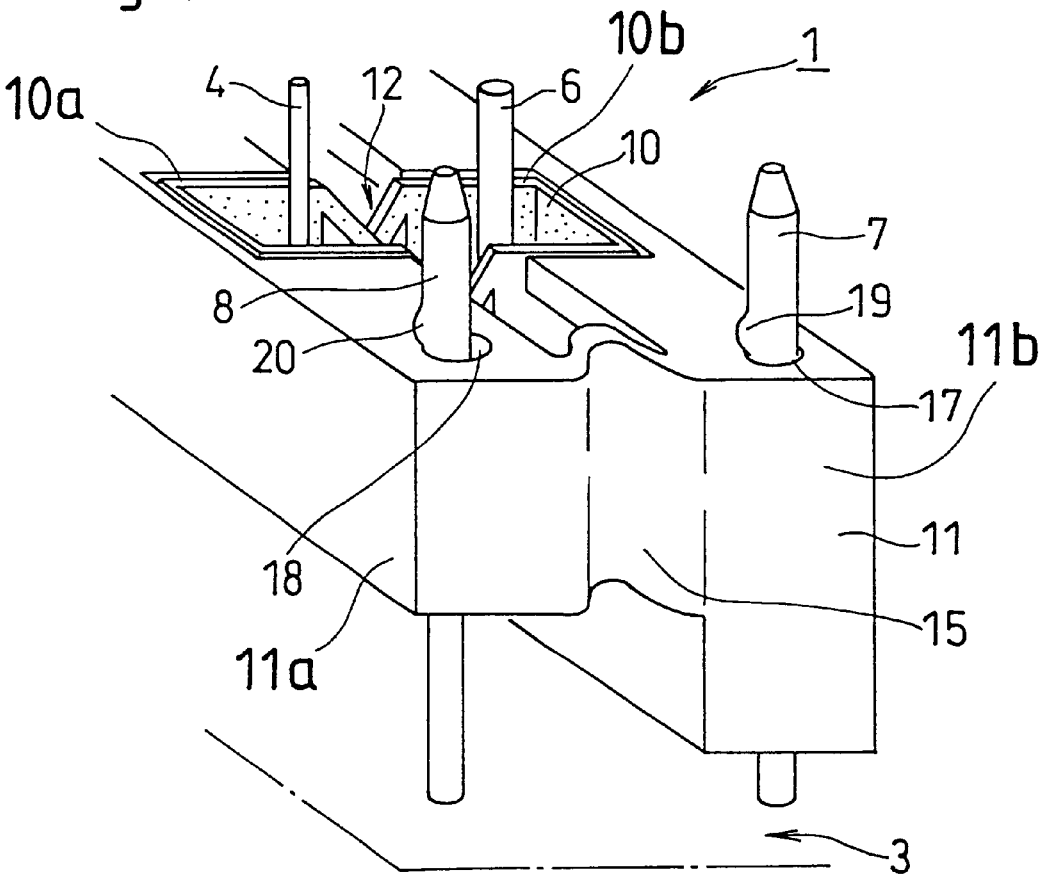
FIG. 2 is a diagram for describing a third aspect of the connector in accordance with the present invention, and depicts a part of the connector by a perspective view.

In FIG. 2, the connector 1 connects the header pin 4, which is a signal terminal of the printed circuit board 2 side, and the header pin 6, which is a signal terminal of the semiconductor device 3 side. The socket 11 comprises a part 11*a* of the printed circuit board 2 side, and a part 11*b* of the semiconductor device 3 side, and a socket connecting part 15 which connects both parts 11*a* and 11*b*. The socket connecting part 15 is formed to be a bellows state so that the socket connecting part 15 becomes flexible and deformable, and when a relative position between both socket parts 11*a* and 11*b* change, the socket connecting part 15 expands or contracts to absorb the positional shift between both socket parts 11*a* and 11*b*.

The configuration of the socket connecting part 15 is not limited to the above mentioned configuration but can be any configuration only if both socket parts can be connected regardless the distance between both socket parts.

In the socket part 11*a* of the semiconductor device 3 side and the socket part 11*b* of the printed circuit board 2 side, a first opening 17 and a second opening 18 which vertically penetrate are formed respectively. In the openings 17 and 18, the alignment pin 7 of the semiconductor device 3 side and the alignment pin 8 at the printed circuit board 2 side are inserted, and by the insertion of these pins 7 and 8, the header pin 6 of the semiconductor device 3 side, the header pin 4 of the printed circuit board 2 side and the contact area 10 can be aligned.

Protrusions 19 and 20 are formed on a part of the alignment pins 7 and 8, and the alignment pins 7 and 8 inserted into the first and second openings 17 and 18 are engaged with the opening edge of the openings 17 and 18 respectively so that the alignment pins do not come out of the socket 11.

A shape of at least one opening of the openings 17 and 18 for alignment is elliptical, and the major axis of the ellipse is in the arrangement direction of the openings 17 and 18. By forming the opening for alignment to be elliptical, positional shift is absorbed between the header pins 4 and 6 and the socket 11, so that the insertion of the header pins 4 and 6 becomes easier.

Figure 3:
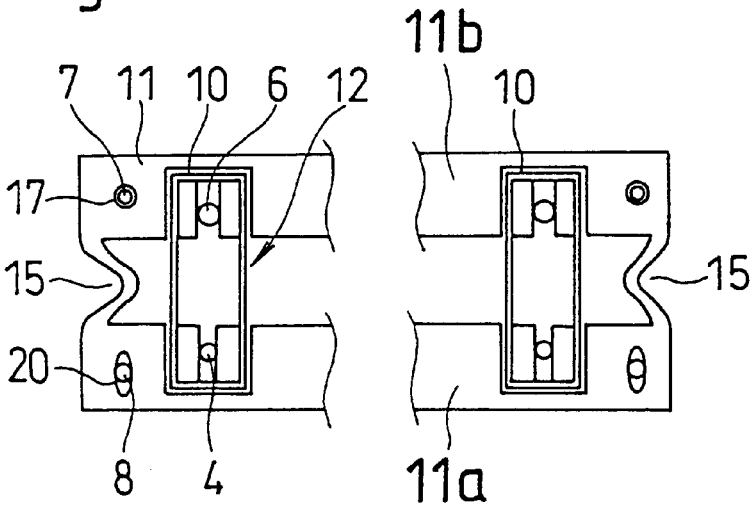
FIG. 3 is a plan view of the connector in FIG. 2 (center portion is omitted)

One or more contact areas 10 are disposed between the socket part 11*a* and the socket part 11*b*, as shown in FIG. 3. The contact area comprises a part 10*a* of the printed circuit board 2 side, a part 10*b* of the semiconductor device 3 side, and a contact connecting part 12 having deformable flexibility which connects both parts 10*a* and 10*b*.

The contact connecting part 12 is disposed to be positioned in a space between the two socket parts 11*a* and 11*b*. As a result, if positional shift exists between the semiconductor device 3 side and the printed circuit board 2 side, the contact connecting part 12 and the socket connecting part 15 deform to absorb the positional deviation. The contact connecting part 12 can be formed with a metal material that has resilience, such as phosphor bronze, and can be integrated with the contact part 14.

The contact part 14 and the contact connecting part 12 can be formed with different members, or the contact part 14 and the contact connecting part 12 can be integrated.

In the first to the third aspects of the connector, the contact part 14 of the contact area 10 is elongated to the direction roughly perpendicular to the insertion or the extraction direction of the header pins 4 and 6 (transverse direction). Therefore, contact between the header pins 4 and 6 and (the pieces 14*c* and 14*d* of) the contact area is always maintained even if the header pins 4 and 6 shift in a transverse direction relative to the contact area 10. As a consequence, even if the distance between the header pins 4 and 6 is changed by positional shift between the semiconductor device 3 side and the printed circuit board 2 side, the positional shift between the header pins 4 and 6 can be absorbed by the shift of the contacting location of the connector area with the header pins 4 and 6.

Function of the Contact Area

Next the configuration and function of the contact area is described referring to FIG. 4A to FIG. 7. In FIG. 4A to FIG. 7, the contact area 10 is positioned in the XYZ space. X direction is a direction in which the header pin 4 and the header pin 6 are arranged, Z direction is the center of axis direction of the header pin 4 and the header pin 6, and Y direction is a direction vertical to both X and Z.

Figure 4A:
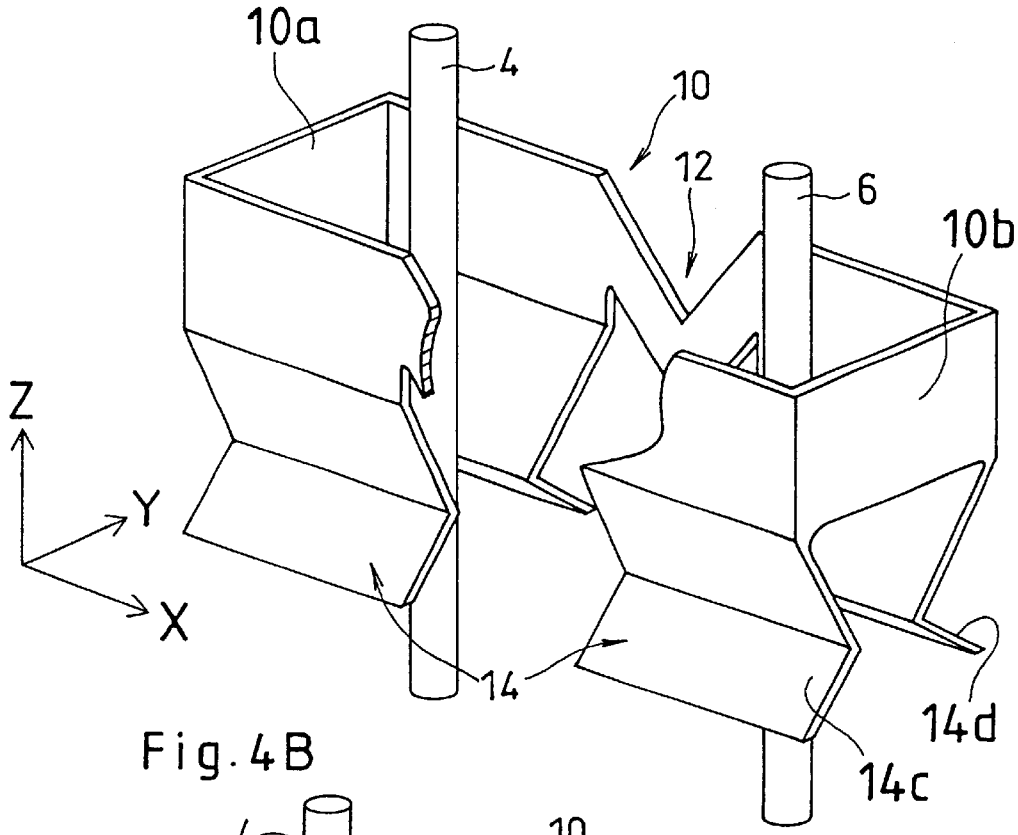
FIG. 4A and FIG. 4B are diagrams for describing that the connector area shown in FIG. 1 maintains contact with header pins even if the distance between the header pins changes.

As FIG. 4A shows, the contact area 10 has the contact part 14 which contacts the header pins 4 and 6, and the contact part 14 is configured by a pair of conductive pieces 14*c* and 14*d* disposed facing each other. Each one of the pieces 14*c* and 14*d* is elongated in a direction (X direction) which is roughly perpendicular to the insertion and extraction direction (Z direction) of the header pins 4 and 6, and has a curved part which protrudes to the direction facing each other (Y direction). The pieces 14*c* and 14*d* have resilience, so that the pieces 14*c* and 14*d* are spread by insertion of the header pins 4 and 6 and return to the initial state by extraction. The curved part of the pieces 14*c* and 14*d* is elongated in the X direction, and contacts with the header pins 4 and 6 at one location.

Figure 4B:
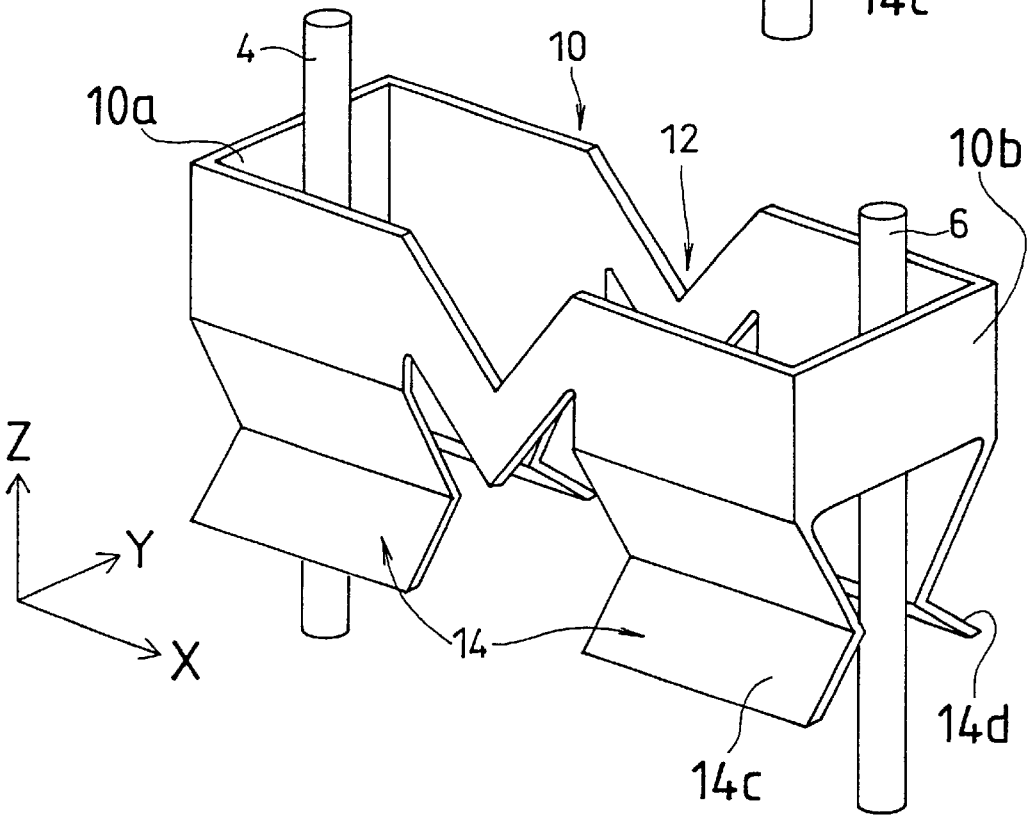

Therefore, even if the header pins 4 and 6 are inserted between the pieces 14*c* and 14*d* of the contact part 14, the pieces 14*c* and 14*d* are spread by the header pins 4 and 6, and at the same time, press the header pins 4 and 6 due to its resilience, and maintain contact with the header pins 4 and 6 at one location of the curved part of each piece 14*c* and 14*d*. The curved parts of the pieces 14*c* and 14*d* are elongated in the X direction, as described above, therefore even if the space between the header pin 4 and the header pin 6 is changed by the positional shift between the semiconductor device 3 side and the printed circuit board 2 side, the header pins 4 and 6 always contact at the same location of the curved part elongated in the X direction. FIG. 4B shows that the pieces 14*c* and 14*d* of the contact part 14 continue pressing (that is, maintain contact) the header pins 4 and 6 from both sides due to their resilience even if the space between the header pin 4 and the header pin 6 spreads in the X direction from the position shown in FIG. 4A.

In this way, even if the relative position of the header pin 4 and the header pin 6 to the contact area 10 changes, the contact area 10 absorbs the positional change and maintains contact, therefore influence on the components mounted on the printed circuit board can be minimized.

The contact part 14 in the part 10*a* of the printed circuit board side (header pin 4 side) of the contact area 10 and the contact part 14 in the part 10*b* of the semiconductor device side (header pin 6 side) are both connected by the conductive and deformable contact connecting part 12. The contact connecting part 12 is deformable because of the narrow V shape, as shown in FIG. 4B. Therefore the positional shift of the semiconductor device relative to the printed circuit board can be absorbed by the deformation of the contact connecting part 12.

Figure 5:
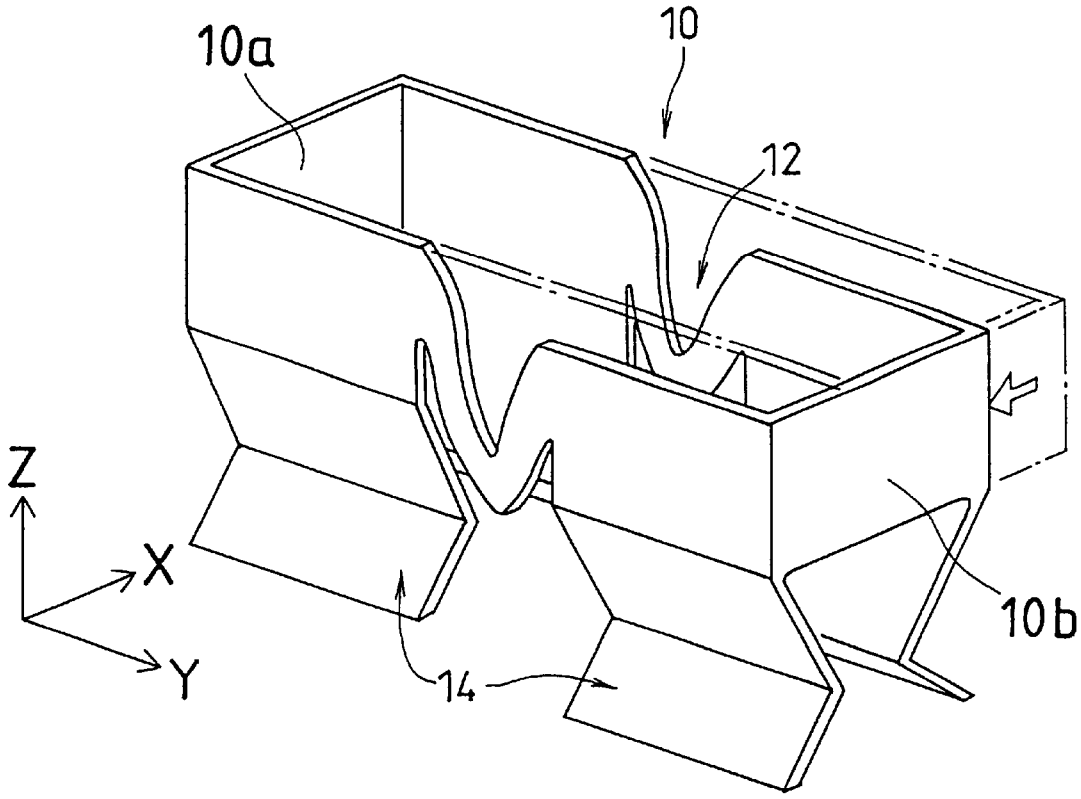
FIG. 5 to FIG. 7 are diagrams for describing that even if one side part of the contact area shifts in any direction of three axes perpendicular to the other side part, the connecting part connecting the one side part and the other side part deforms in that direction.
Figure 6:
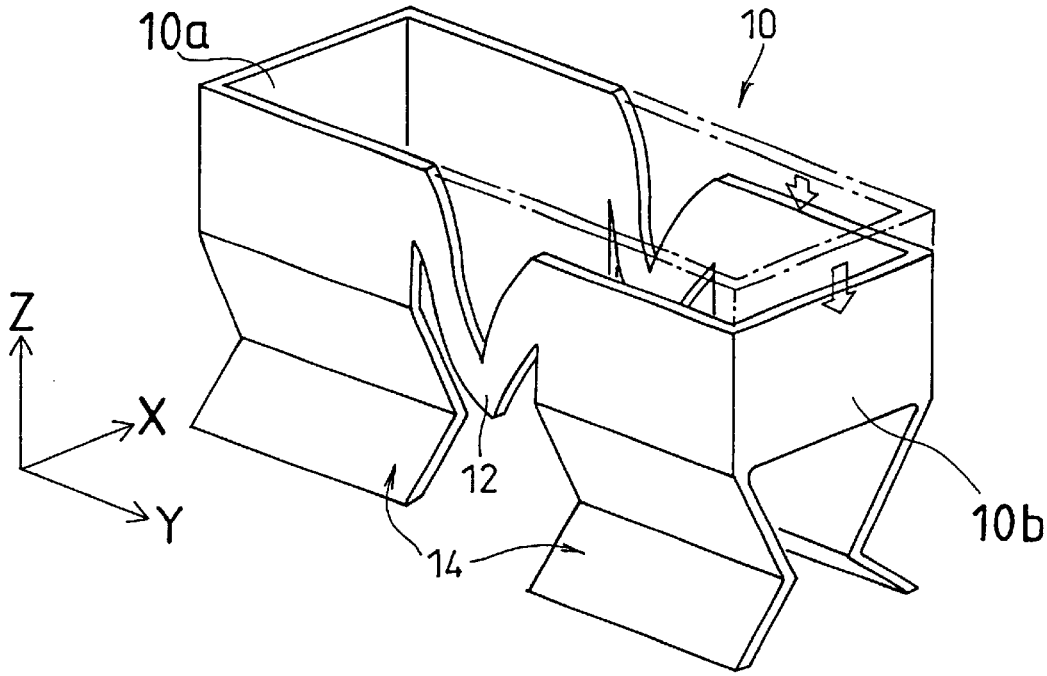
Figure 7:
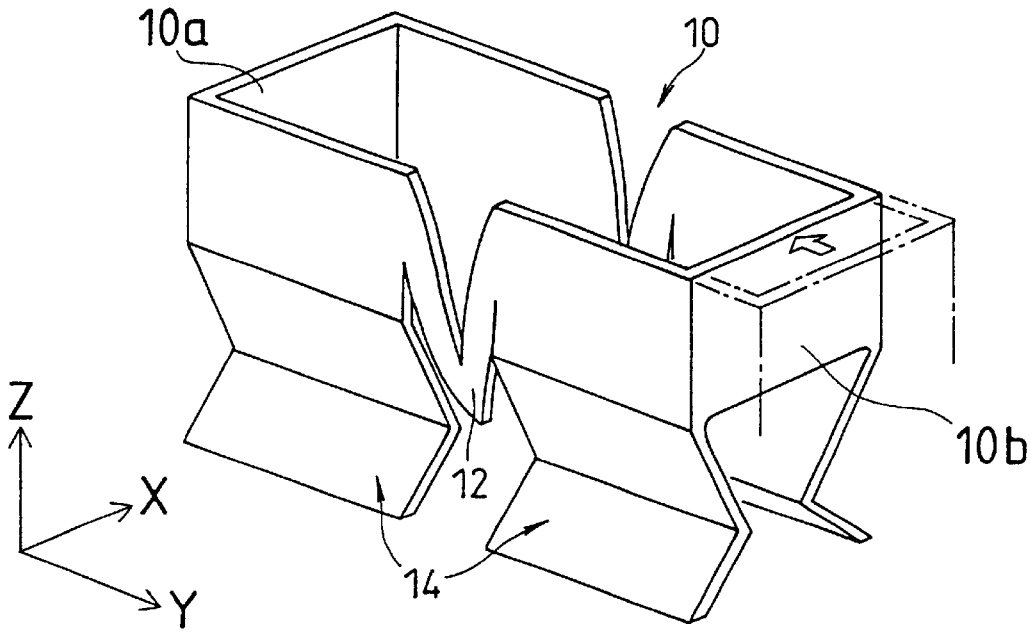

Now the deformation of the contact area 10, which occurs according to the positional shift between the printed circuit board side (header pin 4 side) and the semiconductor device side (header pin 6 side), is described referring to FIGS. 5, 6 and 7.

FIG. 5 shows the case when the part 10*b* of the semiconductor device side of the contact area 10 is shifted in the X direction (the arrow mark direction in FIG. 5) relative to the part 10*a* of the printed circuit board side. In this case, the contact connecting part 12 of the contact area 10 deforms in the X direction, so that the contact part 14 of the part 10*a* of the contact area maintains contact with the header pin 4, and the contact part 14 of the part 10*b* maintains contact with the header pin 6 respectively.

FIG. 6 shows the case when the part 10*b* of the semiconductor device side of the contact are 10 is shifted in the Z direction (the arrow mark direction in FIG. 6) relative to the part 10*a* of the printed circuit board side. In this case, the contact connecting part 12 of the contact area 10 deforms in the Z direction so that the contact part 14 of the part 10*a* of the contact area 10 maintains contact with the header pin 4, and the contact part 14 of the part 10*b* maintains contact with the header pin 6 by sliding respectively.

FIG. 7 shows the case when the part 10*b* of the semiconductor device side of the contact area 10 is shifted in the Y direction (the arrow mark direction in FIG. 7) relative the part 10*a* of the printed circuit board side. In this case, the contact connecting part 12 of the contact area 10 deforms in the Y direction, so that the contact part 14 of the part 10*a* of the contact area 10 maintains contact with the header pin 4, and the contact part 14 of the part 10*b* maintains contact with the header pin 6 by sliding respectively.

The above description is the case when the part 10*b* of the semiconductor device side of the contact area 10 is shifted relative to the part 10*a* of the printed circuit board side in an X, Y, or Z direction, but even when the positional shift is in an X, Y and Z combined direction, the contact connecting part 12 deforms in the combined direction, and as a consequence the contact part 14 of the part 10*a* of the contact area 10 can maintain contact with the header pin 4, and the contact part 14 of the part 10*b* can maintain contact with the header pin 6 by sliding respectively.

Figure 8A:
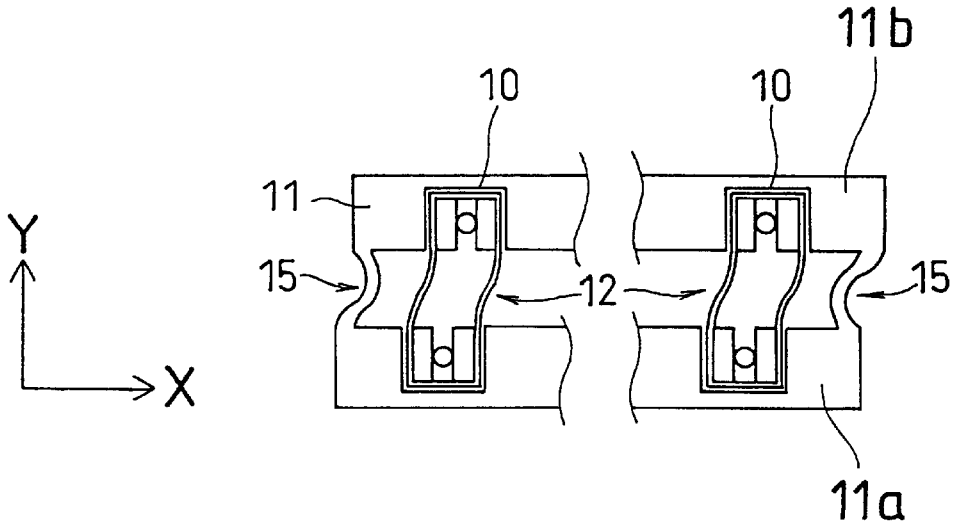
FIG. 8A and FIG. 8B are diagrams for describing aspects when the socket and contact area of the connector shown in FIG. 2 are deformed in one direction and in a direction vertical to that direction respectively.
Figure 8B:
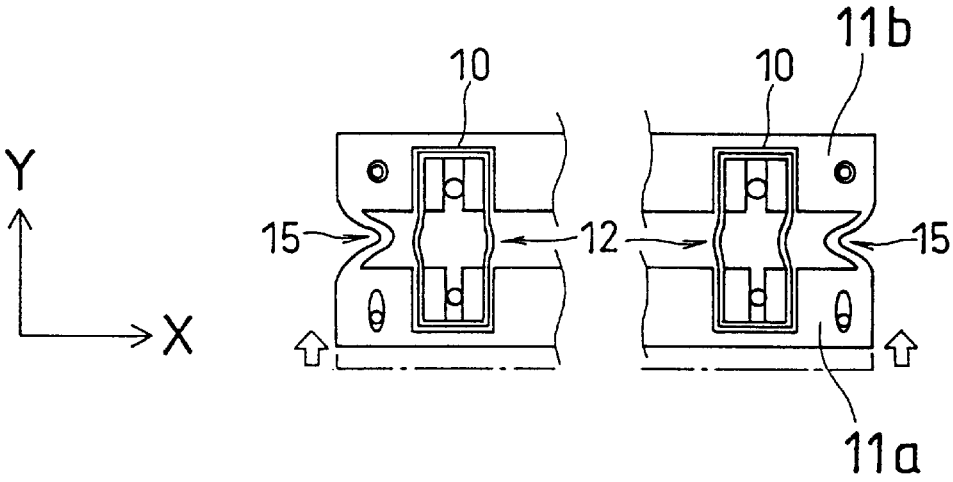

Now deformation of the socket 11 and the contact area 10 caused by positional shift is described referring to FIG. 8A and FIG. 8B.

When the part 11*b* of the semiconductor device 3 side of the socket 11 is shifted in the X direction relative to the part 11*a* of the printed circuit board 2 side, the shift is absorbed by deformation of the socket connecting part 15 in the X direction, as shown in FIG. 8A. The contact area 10 also causes similar positional shift at the same time, but the positional shift is absorbed by the deformation of the contact connecting part 12 in the X direction.

When the part 11*b* of the semiconductor device 3 side of the socket 11 is shifted in the Y direction relative to the part 11*a* of the printed circuit board side, the shift is absorbed by deformation of the socket connecting part 15 in the Y direction, as shown in FIG. 8B. The contact area 10 also causes similar positional shift at the same time, but the positional shift is absorbed by the deformation of the contact connecting part 12 in the Y direction.

Even when the part 11*b* of the semiconductor device 3 side of the socket 11 is shifted in an X and Y combined direction relative to the part 11*a* of the printed circuit board 2 side, that shift and the shift of the contact area are absorbed by deformation of the socket connecting part 15 and the contact connecting part 12 in the same direction.

Figure 9:
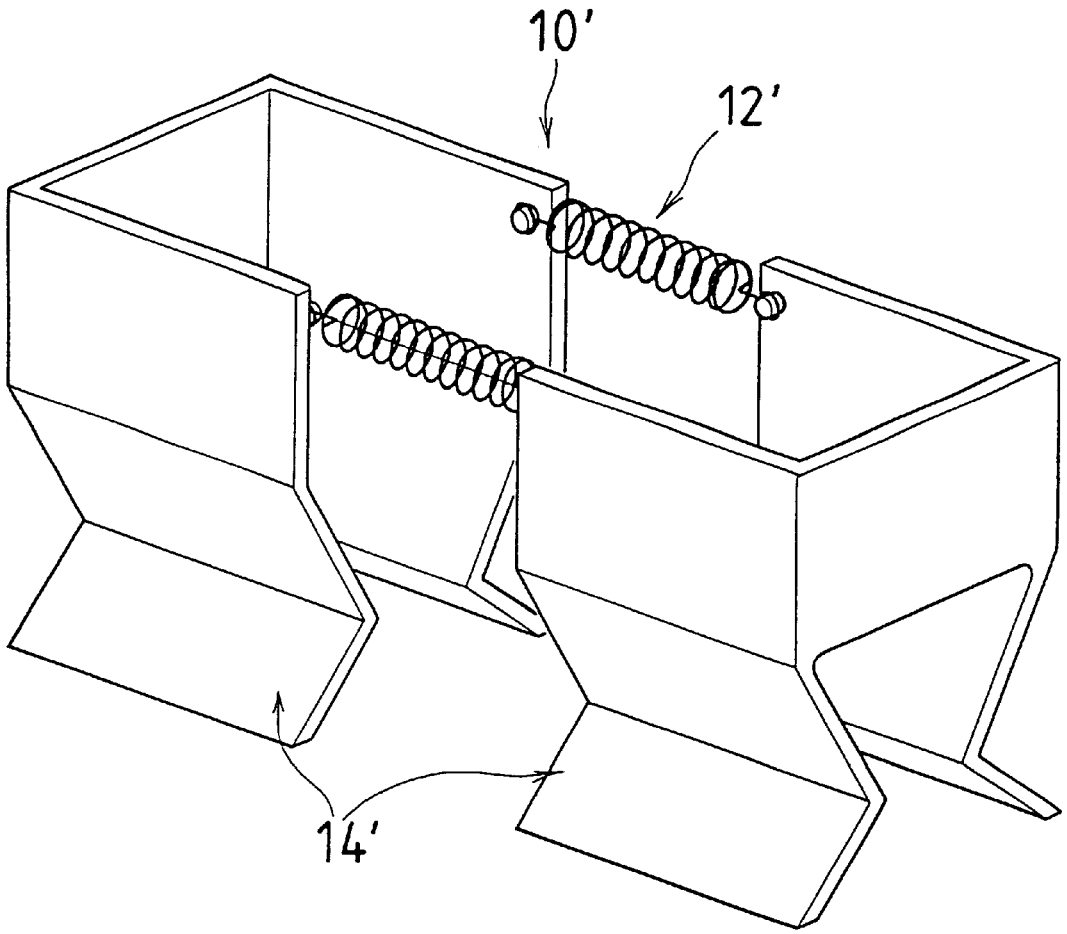
FIG. 9 is a perspective view depicting another aspect of the contact area used for the connector in FIG. 1.
Figure 10:
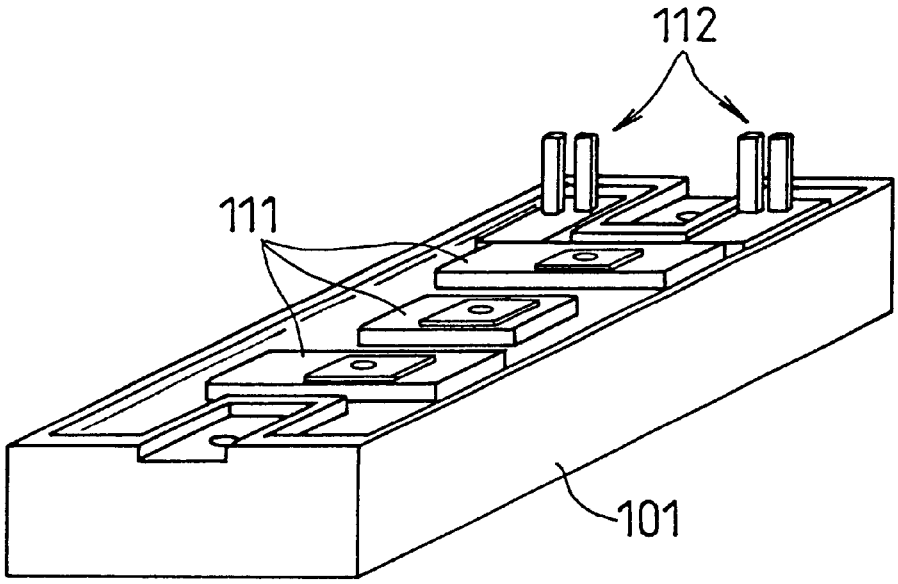
FIG. 10 is a perspective view depicting a conventional semiconductor signal connector using connection by fastening tabs.
Figure 11:
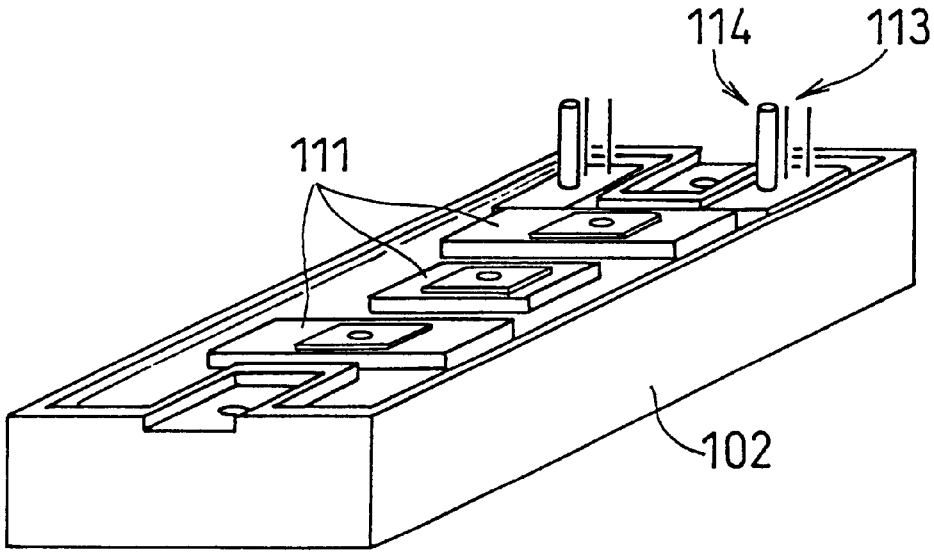
FIG. 11 is a perspective view depicting a conventional semiconductor (IGBT) signal connector using connection by header pins.
Figure 12:
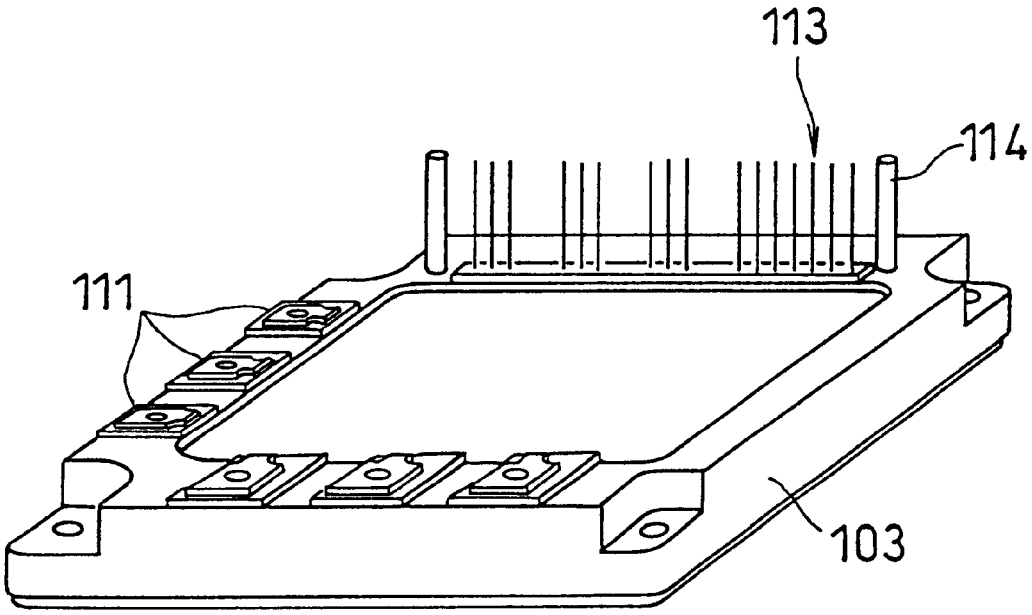
FIG. 12 is a perspective view depicting a conventional semiconductor (IPM) signal connector using connection by header pins.
Figure 13:
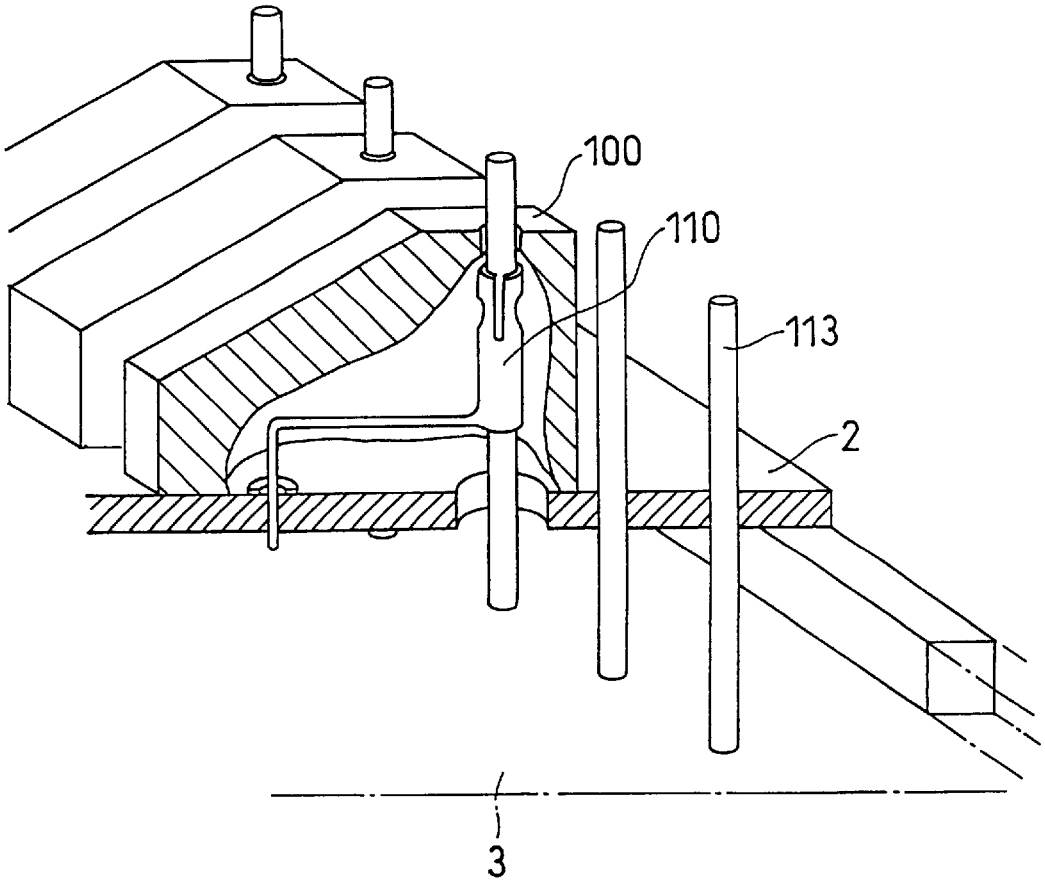
FIG. 13 is a perspective view (partial cross-sectional view) for describing connection by a conventional connector.

FIG. 9 shows an example of a contact area in a different embodiment from the contact area 10 shown in FIG. 4A to FIG. 7.

In the contact area 10' shown in FIG. 9, the contact connecting part 12' is formed with flexible conductive wires. By connecting each end of the conductive wire to the contact parts 14', the contact parts 14' are electrically connected to each other. Also, because of the flexibility of the conductive wires, positional shift between the semiconductor device side and the printed circuit board side, and positional deviation of the header pins can be absorbed. In FIG. 9, however, the contact connecting parts 12' only connect the contact parts 14' electrically, and the socket connecting part connects them mechanically.

According to the embodiment of the semiconductor signal connector of the present invention, the contact part of the contact area has a wide width, and contact locations with the signal terminal are transversely extended so that the positional shift of the header pins can be absorbed.

Positional shift between the semiconductor device side and the printed circuit board side can also be absorbed by dividing the contact part of the contact area and connecting the divided contact parts with a contact connecting part.

Positional shift between the semiconductor device side and the printed circuit board side can also be absorbed by dividing the socket part supporting the contact area, and connecting the divided socket parts with a socket connecting part.

What is claimed is:

1. A semiconductor signal connector, comprising:

a closed rectangular conductive contact area which contacts a pair of signal terminals and which includes an elongated contact part elongated in a direction perpendicular to an axial direction of the signal terminals with an elongation length long enough to allow the terminals to slide along the elongated contact part, so that the signal terminals can contact any location of the elongated contact part of the rectangular conductive contact area.

2. The semiconductor signal connector as recited in claim 1, wherein an elongation length of the contact part is determined based on the maximum positional shift between the signal terminal and the semiconductor signal connector.

3. A rectangular semiconductor signal connector, comprising:

a first contact part to slide over a first signal terminal on a first end of the rectangular connector;

a second contact part to slide over a second signal terminal on a second end of the rectangular connector; and a connecting part formed by a deformable member for connecting the first contact part and the second contact part.

4. The semiconductor signal connector according to claim 3, wherein said first contact part, the second contact part and the connecting part are integratedly molded by a same conductive member.

5. The semiconductor signal connector as recited in claim 3, wherein said connecting part is formed with a narrower width than said first and second contact parts.

6. The semiconductor signal connector as recited in claim 5, wherein said connecting part is roughly V shaped.

7. The semiconductor signal connector as recited in claim 3, wherein said connecting part is formed with a conductive wire.

8. A semiconductor signal connector comprising:

a rectangular socket formed with an insulating material and a first conductive contact area and a second conductive contact area attached in an area formed in said socket;

said first conductive contact area further comprising a first part to slide over a first signal terminal, and said second conductive contact area further comprising a second part to slide over the second signal terminal, and a connecting part connecting said first and second part, wherein said connecting part includes a material or a structure which enables shifting the second part relative to the first part; and a part of said socket is formed with a flexible material so that the second part can be shifted relative to the first part of said connector.

9. A connector for making electrical contact with two terminals, comprising:

a closed rectangular contact area adapted to fit over the terminals, the contact area being elongated in a direction perpendicular to a direction of the terminals with an elongation length long enough to allow the terminals to slide along the contact area.

* * * * *